US006390070B2

(12) United States Patent
Coldren et al.

(10) Patent No.: US 6,390,070 B2
(45) Date of Patent: May 21, 2002

(54) PRESSURE-INTENSIFYING HYDRAULICALLY-ACTUATED ELECTRONICALLY-CONTROLLED FUEL INJECTION SYSTEM WITH INDIVIDUAL MECHANICAL UNIT PUMPS

(75) Inventors: Dana R. Coldren, Fairbury; Charles D. Ellenbecker, Normal, both of IL (US); Phillip J. Houtz, Lafayette, IN (US); Adrian Hsieh, Normal, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/834,070

(22) Filed: Apr. 12, 2001

Related U.S. Application Data

(63) Continuation of application No. 09/349,910, filed on Jul. 8, 1999, now abandoned.

(51) Int. Cl.[7] ..... F02M 37/04

(52) U.S. Cl. ..... 123/506; 123/502

(58) Field of Search ..... 123/506, 507, 123/508, 502, 514, 447, 468, 490; 251/129.01

(56) References Cited

U.S. PATENT DOCUMENTS 4,217,862 A * 8/1980 Fork et al.
4,421,088 A * 12/1983 Seilly
4,440,132 A * 4/1984 Terada et al.
4,448,169 A * 5/1984 Badgley et al.
4,471,740 A 9/1984 Jourde et al.
4,719,889 A * 1/1988 Amann et al.
4,884,545 A * 12/1989 Mathis
4,957,085 A 9/1990 Sverdlin
5,056,469 A * 10/1991 Kimberley
5,094,215 A * 3/1992 Gustafson
5,152,271 A * 10/1992 Matsumura
5,176,120 A * 1/1993 Takchashi
5,413,076 A 5/1995 Koenigswieser et al.
5,529,044 A * 6/1996 Barnes et al.
5,615,656 A * 4/1997 Mathis
5,622,152 A * 4/1997 Ishida
5,673,669 A 10/1997 Maley et al.
5,709,194 A * 1/1998 Moncelle
5,896,841 A * 4/1999 Nemoto et al.
5,986,871 A * 11/1999 Forck et al.

FOREIGN PATENT DOCUMENTS

GB 2308157 * 6/1997

* cited by examiner

*Primary Examiner*—Henry C. Yuen
*Assistant Examiner*—Mahmoud M Gimie
(74) *Attorney, Agent, or Firm*—Liell & McNeil

(57) ABSTRACT

A fuel injection system includes a plurality of mechanical unit pumps, each of which has a pump outlet. A pressure-intensifying hydraulically-actuated electronically-controlled fuel injector is provided for each of the plurality of mechanical unit pumps. Each of the fuel injectors has a direct control needle valve and an injector body that defines an actuation fluid inlet, a fuel inlet, an actuation fluid cavity and a fuel pressurization chamber. Each fuel injector also includes a moveable pumping element with a large hydraulic surface exposed to fluid pressure in the actuation fluid cavity, and a small hydraulic surface exposed to fluid pressure in the fuel pressurization chamber. An actuation fluid supply line is provided for each of the plurality of mechanical unit pumps. Each supply line has one end connected to one pump outlet and an other end connected to one actuation fluid inlet of an individual fuel injector.

20 Claims, 7 Drawing Sheets

14
41
45
42
61
62
40
12
63
26
44
71
72
11
46
47
48
63
54
60
49
53
18
73
66
64
50
67
55
51
65
52
57
56
79
78
43
19
70
76
77
68
73
74
80

12
42
44
26
49
53
66
60
50
73
56
59
63
47
64
65
48
74
57
76
80

FILL

PRESSURIZE

START INJECTION

END INJECTION

SPILL 112
163
160
150
173
170
165
147
156
157

FILL

PRESSURIZE

START INJECTION

END INJECTION

SPILL 212
264
260
273
250
265
270

FILL

PRESSURIZE

START INJECTION

END INJECTION

SPILL

PRESSURE-INTENSIFYING HYDRAULICALLY-ACTUATED ELECTRONICALLY-CONTROLLED FUEL INJECTION SYSTEM WITH INDIVIDUAL MECHANICAL UNIT PUMPS

This application is a con of Ser. No. 09/349910 filed Jul. 8, 1999, ABN.

TECHNICAL FIELD

The present invention relates generally to hydraulically-actuated fuel injection systems, and more particularly to pressure-intensified hydraulically-actuated fuel injection systems with direct control needle valves.

BACKGROUND ART

There has been a continuing trend in internal combustion engine design to independently control fuel injection timing and duration in order to improve performance and decrease undesirable emissions. One method of decoupling the operation of the fuel injection system from the rotation angle of the engine is to utilize hydraulically-actuated fuel injectors that are electronically controlled in their operation. In this way, virtually any amount of fuel can be introduced into an individual engine cylinder at any time in the engine cycle.

Caterpillar Inc. of Peoria, Ill. has experienced considerable success in the incorporation of its common rail hydraulically-actuated fuel injection systems in a range of diesel engines. While these hydraulic systems have performed magnificently for many years, some engine applications are not particularly well suited to the use of common rail hydraulic systems for a variety of reasons known in the art. For example, one class of relatively large diesel engines utilize heavy fuel oil that by its normally highly viscous nature renders it generally unsuitable for common rail type fuel injection systems.

In another type of fuel injection system, a conventional cam driven plunger is used to pressurize fuel, but control over each injection event is initially maintained by spilling fuel to control the time at which fuel pressure reaches injection levels. However, those skilled in the art will appreciate that some engines and/or engine applications are not particularly well suited to the positioning of a cam shaft in close proximity to the fuel injectors.

In still another class of engines, a conventional pump and lines system is employed. These systems utilize individual cam driven mechanical unit pumps spatially separated from injection nozzles but fluidly connected via individual high pressure fuel lines. These systems often lack electronic control and undesirably require the plumbing of cyclically high pressure fuel around a hot engine.

Thus, while the specific fuel system capabilities of different engines vary, there remains a continuing trend toward introducing electrical control in order to improve engine performance and decrease undesirable emissions. While this trend has been more forthcoming in the field of engines that burn distillate diesel fuel, this trend has been more difficult to accomplish in the relatively large class of diesel engines that burn residual fuels, such as heavy fuel oil. Heavy fuel oil injection systems remain more resistant to the incorporation of electronic controls in part because of the necessity to isolate the heavy fuel plumbing from the electronic systems while retaining a coupling between the electronic actuators and the flow of heavy fuel oil within the individual injection systems.

The present invention is directed to overcoming these and other problems associated with fuel injection systems.

DISCLOSURE OF THE INVENTION

A fuel injection system includes a plurality of mechanical unit pumps, each having a pump outlet. A pressure-intensifying hydraulically-actuated electronically-controlled fuel injector is provided for each of the plurality of mechanical unit pumps. Each of the fuel injectors has a direct control needle valve and an injector body that defines an actuation fluid inlet, a fuel inlet, an actuation fluid cavity and a fuel pressurization chamber. Each fuel injector includes a moveable pumping element with a large hydraulic surface exposed to fluid pressure in the actuation fluid cavity and a small hydraulic surface exposed to fluid pressure in the fuel pressurization chamber. An actuation fluid supply line is provided for each of the plurality of mechanical unit pumps, and each supply line fluidly connects one pump outlet to one actuation fluid inlet.

BEST MODE FOR CARRYING OUT THE INVENTION

Figure 1:
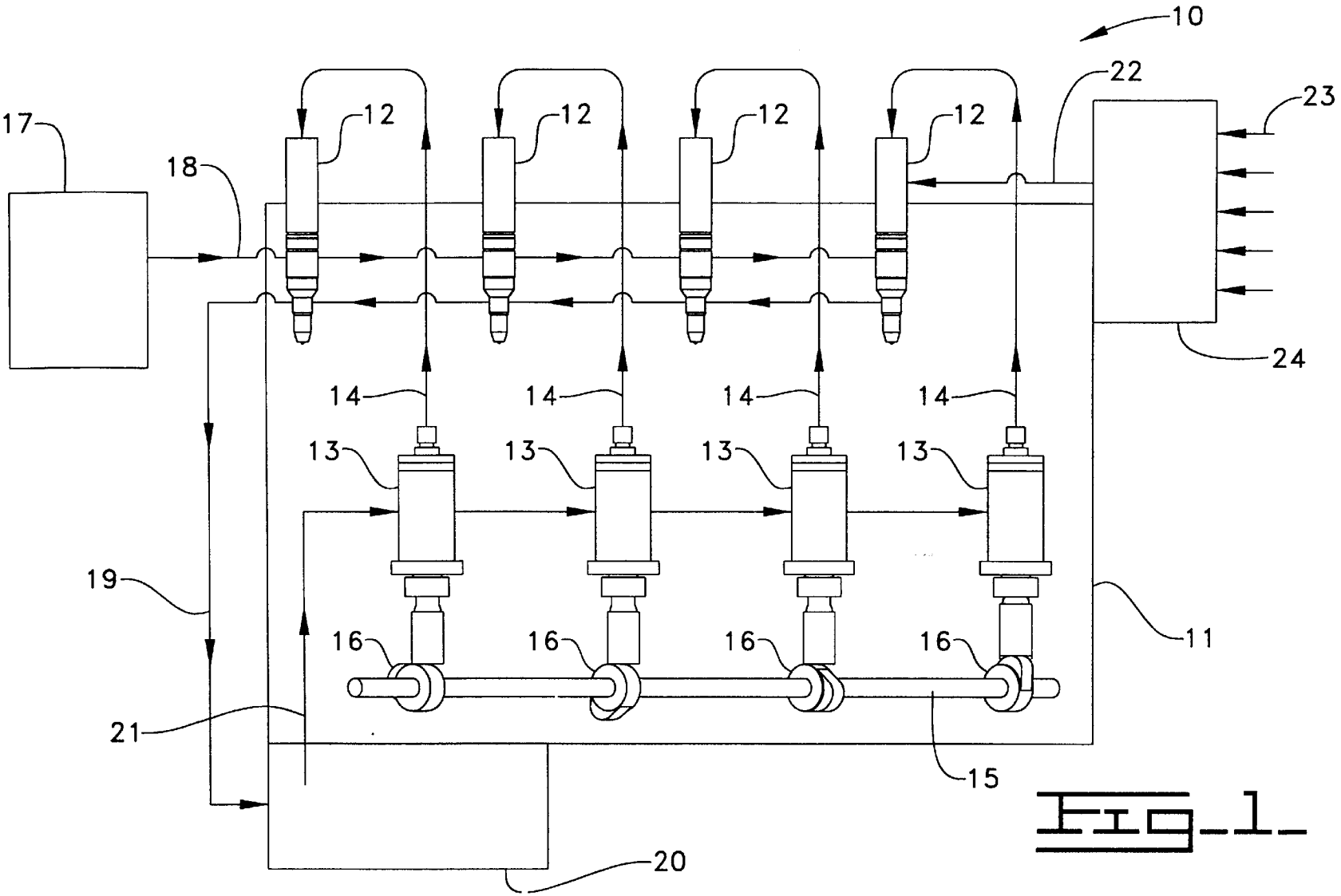
FIG. 1 is a schematic illustration of an engine having a fuel injection system according to the present invention.

Referring now to FIG. 1, a fuel injection system 10 is shown mounted on an engine 11 according to one embodiment of the present invention. Fuel injection system 10 includes a plurality of pressure-intensifying hydraulically-actuated electronically-controlled fuel injectors 12 that are individually supplied with pressurized actuation fluid via a like number of cam actuated mechanical unit pumps 13 and individual actuation fluid supply lines 14. Each mechanical unit pump 13 is preferably driven to reciprocate with a separate cam 16, all of which are mounted on a common camshaft 15 driven directly by engine 11. The mechanical unit pumps 13 preferably draw and pump lubricating oil from actuation fluid reservoir or oil pan 20 via one or more actuation fluid source lines 21. Although any available engine fluid could be used to actuate fuel injectors 12, the present invention preferably utilizes available engine lubricating oil as its hydraulic medium. After performing work within fuel injectors 12, the used hydraulic fluid is returned to oil pan 20 via an actuation fluid return line 19. Each of the fuel injectors 12 is connected to a source of fuel fluid 17 via a fuel supply line 18. Although the present invention could be adapted for use of distillate diesel fuel, this embodiment of the present invention preferably utilizes heavy fuel oil as its fuel fluid. When in operation, fuel injectors 12 are controlled in their activation via a control signal 22 that originates from an electronic control module 24, which monitors a variety of engine and/or system parameters 23 using known sensors and techniques.

Figure 2:
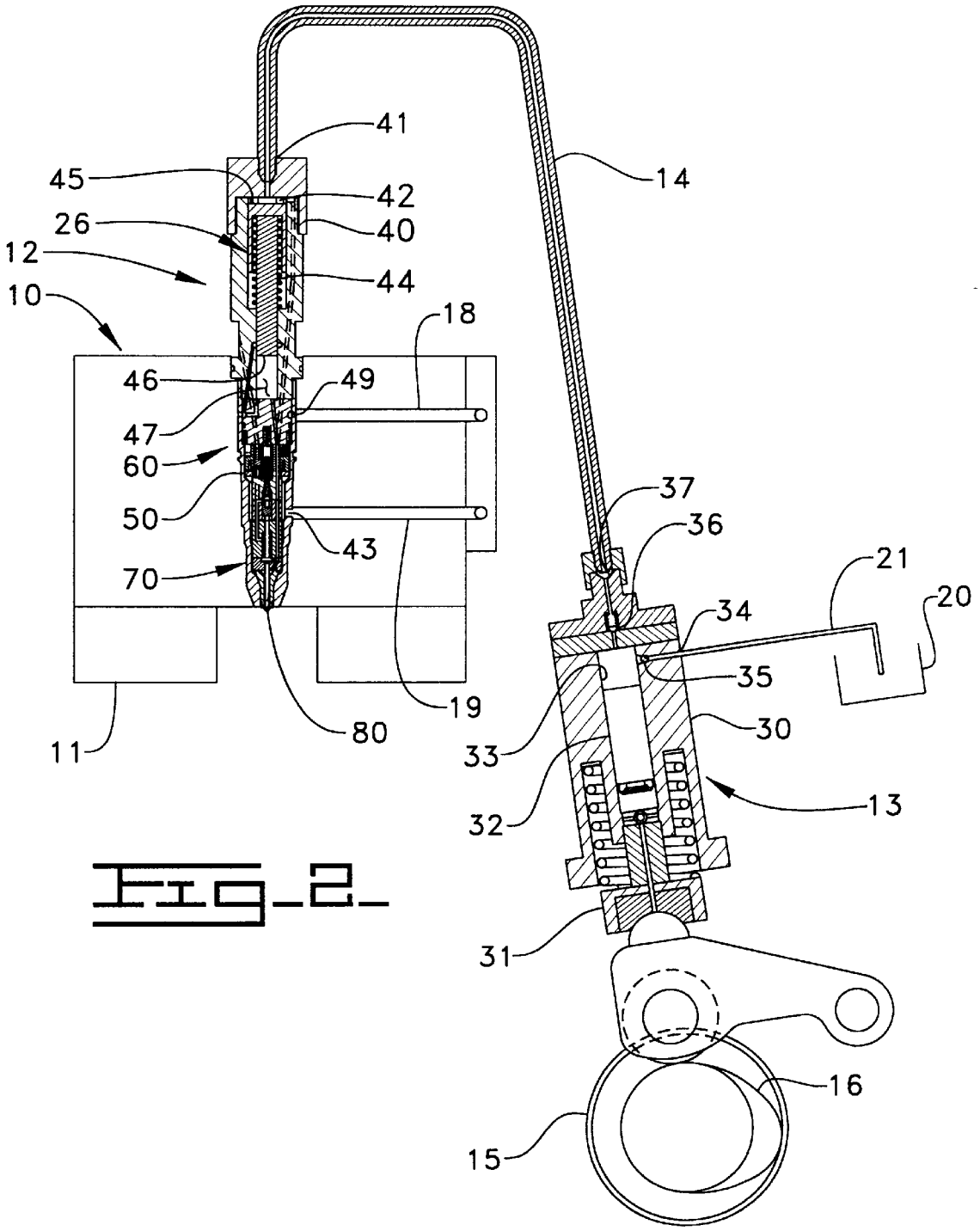
FIG. 2 is a diagrammatic sectioned side view of a single fuel injector and mechanical unit pump combination according to one aspect of the present invention.

Referring now to FIG. 2, each mechanical unit pump 13 includes a pump housing 30 that defines a pump inlet 34 connected to oil pan 20 via a source line 21, and a pump outlet 37 connected to an individual fuel injector 12 via an actuation fluid supply line 14. Mechanical unit pump 13 includes a tappet assembly 31 that reciprocates with a pump plunger 32 in pump housing 30 with each revolution of cam 16. When pump 13 is undergoing its downward return stroke, fresh or new low pressure actuation fluid is drawn into pump chamber 33 past check valve 35. When pump 13 is undergoing its upward pumping stroke, check valve 35 closes and the lubricating oil in pumping chamber 33 is displaced past check valve 36 and out of pump outlet 37 toward injector 12 in supply line 14.

The actuation fluid supply line 14 has one end connected to the pump outlet 37 of an individual mechanical unit pump 13 and its other end connected to an actuation fluid inlet 41 of an individual fuel injector 12. As stated earlier, a fuel supply line 18 is connected to a fuel inlet 49 of each fuel injector, and an actuation fluid return line 19 is connected to an actuation fluid drain 43. Each fuel injector 12 includes a pumping element 26 that includes a large hydraulic surface 45 that is exposed to fluid pressure in an actuation fluid cavity 42, and a small hydraulic surface 46 that is exposed to fluid pressure in a fuel pressurization chamber 47. Pumping element 26 is positioned within injector body 40 and normally biased toward its upward retracted position by a return spring 44, but is moveable downward during its pumping stroke to an advanced position. A portion of the actuation fluid entering fuel injector body 40 is channeled toward actuation fluid cavity 42, and another portion is channeled downward toward a spill valve 60 and a direct control needle valve 70 via actuation fluid passage 63. Both spill valve 60 and needle valve 70 are controlled by a single electrical actuator 50. Finally, each injector body 40 defines a nozzle outlet 80 that is suitably positioned within a combustion space within engine 11.

Figure 3:
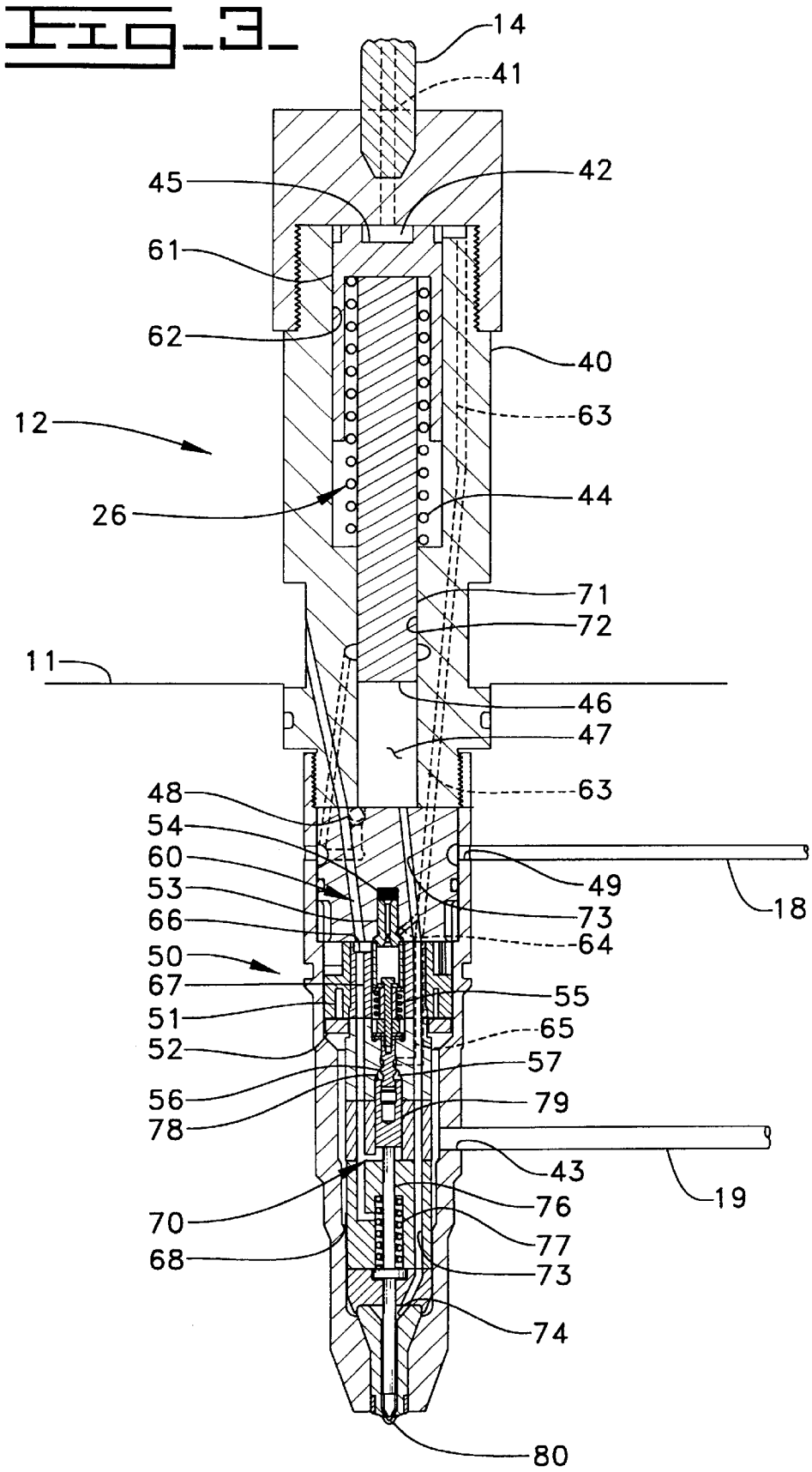
FIG. 3 is a diagrammatic sectioned side view of a fuel injector according to one aspect of the present invention.
Figure 4:
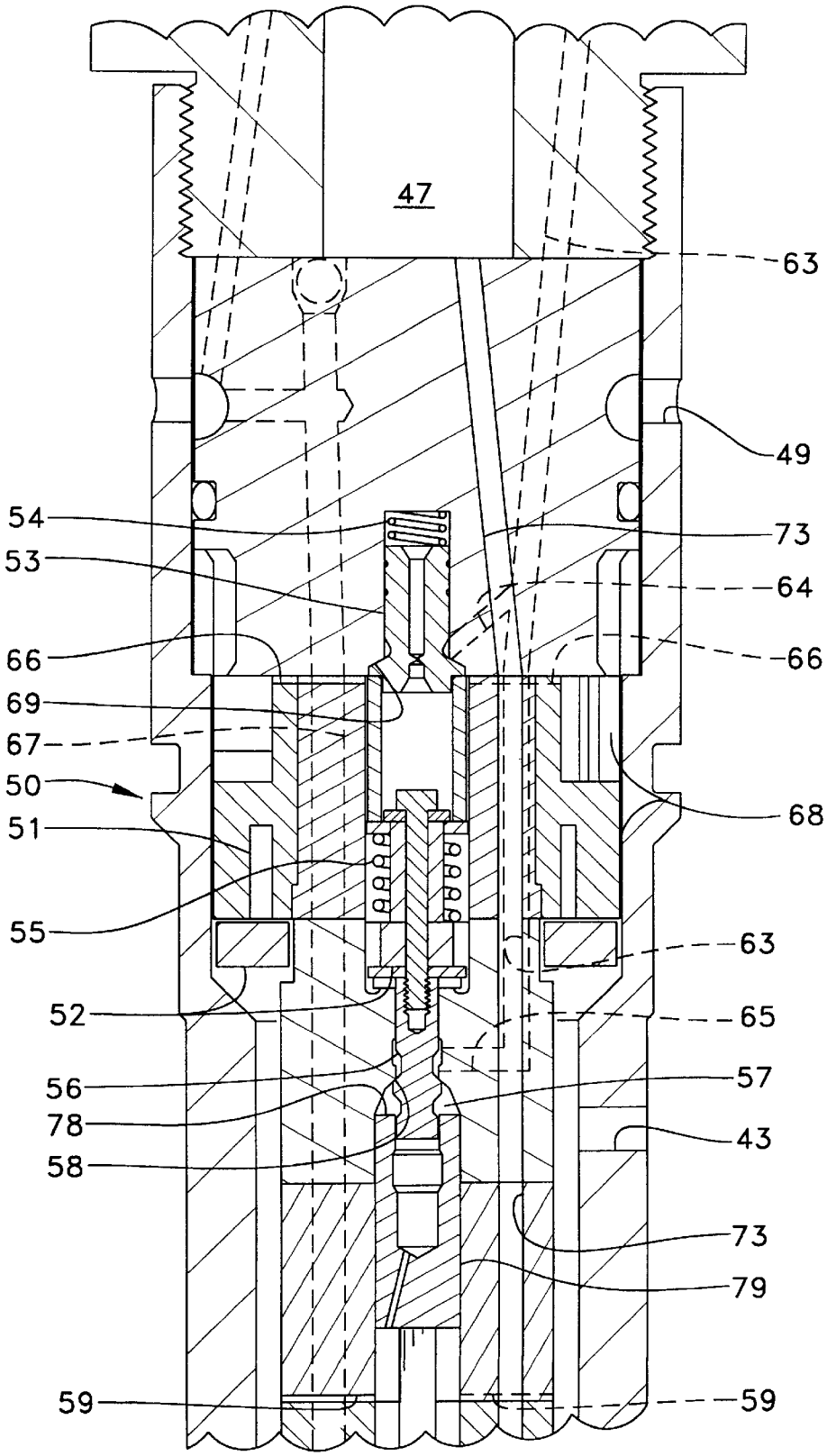
FIG. 4 is an enlarged diagrammatic sectioned side view of the control valve portion of the fuel injector of FIG. 3.

Referring now in addition to FIGS. 3 and 4, the various internal components and passageways within fuel injector 12 appear as if they would just before the initiation of an injection event. The pumping element 26 of fuel injector 12 includes an intensifier piston 61 that moves in a piston bore 62, and a plunger 71 that moves within a plunger bore 72. Piston 61 and plunger 71 move in unison and are normally biased upward toward their retracted position by a return spring 44. Piston 61 has a relatively large hydraulic surface 45 exposed to fluid pressure in actuation fluid cavity 42, and plunger 72 has a relatively small hydraulic surface area 46 exposed to fluid pressure in fuel pressurization chamber 47, which is defined by a portion of plunger bore 72. Actuation fluid cavity 42 is connected to actuation fluid inlet 41 via an unobstructed connection passage. Actuation fluid inlet 41 is also fluidly connected to actuation fluid passage 63 that fluidly connects in the vicinity of solenoid 50 to a spill passage 64 and a pressure communication passage 65. In order to prevent sticking and protect sensitive electronic components, especially in the case of heavy fuel oil, actuation fluid passage 63 is fluidly isolated from the electronic components and the various passageways that are fluidly connected to fuel pressurization chamber 47. In particular, although they appear to overlap in FIGS. 3 and 4, actuation fluid passage 63, which preferably carries lubricating oil, is fluidly isolated from nozzle supply passage 73, which preferably carries a heavy fuel oil.

When pumping element 26 is undergoing its downward pumping stroke, fuel within fuel pressurization chamber 47 is pressurized, and this pressurization is communicated to nozzle chamber 74 via nozzle supply passage 73. When fuel pressure in nozzle chamber 74 is above a valve opening pressure sufficient to overcome needle biasing spring 77 and direct control needle valve 70 is in its on position, needle valve member 76 will lift to an open position to open nozzle outlet 80 to nozzle chamber 74. Needle biasing spring 77 is positioned in a spring chamber that is vented to low pressure fuel inlet 49 via low pressure passage 67. Between injection events, when plunger 71 is undergoing its upward return stroke, low pressure fuel is drawn through fuel inlet 49, past check valve 48 and into fuel pressurization chamber 47.

The pressurization of fuel and actuation fluid is controlled by the opening and closing of spill valve 60. Spill valve 60 includes a spill valve member 53 that is normally biased toward its downward open position by a weak biasing spring 54. When in this open position, actuation fluid passage 63 communicates with actuation fluid drain 43 via spill passage 64, past spill valve seat 69, into low pressure passage 66, through annular low pressure area 68 and then out of drain 43. Thus, when spill valve member 53 is in its downward open position, any actuation fluid displaced into fuel injector 12 from unit pump 13 (FIGS. 1 and 2) is merely spilled back into actuation fluid return line 19 for recirculation. When this occurs, pressure in actuation fluid cavity 42 remains relatively low and pumping element 26 remains in it upward retracted position.

The pressurization of fuel and thus the initiation of each injection event is triggered by closing spill valve 60. This is accomplished by sending a relatively low current to coil 51 of solenoid 50 such that armature 52 moves upward against the action of weak biasing spring 54 to cause spill valve member 53 to close spill valve seat 69. When this occurs, spill passage 64 closes, and actuation fluid pressure in actuation fluid passage 63 and cavity 42 begin to rise quickly. This high pressure acting on large hydraulic surface 45 causes pumping element 26 to begin its downward pumping stroke. When pumping element 26 begins moving downward, check valve 48 closes and fuel pressure in fuel pressurization chamber 47, nozzle supply passage 73, and nozzle chamber 74 rises quickly to injection levels.

The opening and closing of nozzle outlet 80 to inject fuel is controlled independently of spill valve 60 within an injection event by a direct control needle valve 70, which uses the same solenoid 50 as spill valve 60 but at higher current levels. Direct control needle valve 70 includes a needle control valve member 56 that moves in response to solenoid 50 to open and close needle control chamber 57 to pressure communication passage 65. Needle control valve member 56 is normally biased downward toward its open position by a strong biasing spring 55 when solenoid 50 is de-energized and/or energized at the relatively low current levels necessary to close spill valve 60. When solenoid 50 is energized to the low levels necessary to close spill valve 60, needle control valve member 56 moves upward to a middle position that is still out of contact with needle control seat 58. Direct control needle valve 70 also includes a needle valve member 76 that has an opening hydraulic surface exposed to fuel pressure in nozzle chamber 74, but also includes a needle piston 79 with a closing hydraulic surface 78 exposed to lubricating oil pressure in needle control chamber 57. Closing hydraulic surface 78 is preferably sized such that needle valve member 76 will remain in, or move towards, its downward closed position whenever needle control valve member 56 is in its downward open position to communicate high pressure from actuation fluid passage 63, through pressure communication passage 65, past needle control seat 58 and into needle control chamber 57. When solenoid 50 is energized to its higher current levels, armature 52 further lifts needle control valve member 56 upward to close needle control seat 58 and close the fluid connection between needle control chamber 57 and pressure communication passage 65. When this occurs, a flow clearance within needle piston 79 causes fluid pressure in needle control chamber-57 to drop quickly into equilibrium with the low pressure existing in low pressure passage 59, which is in fluid communication with drain 43 as discussed earlier.

Figures 6A, 6B, 6C, 6D, 6E:
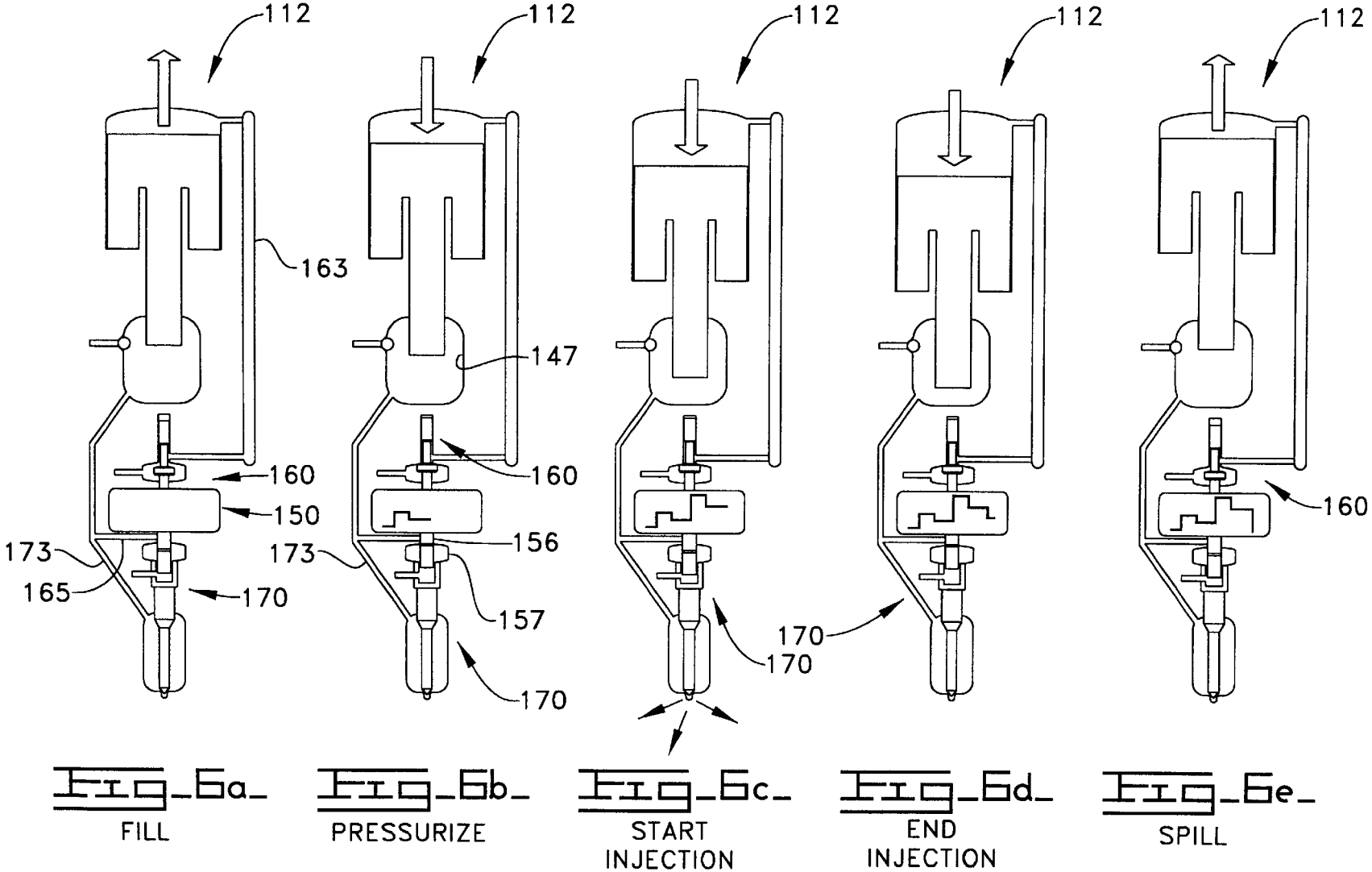
FIGS. 6A–E are a series of diagrammatic illustrations showing a fuel injection sequence for a fuel injector according to another aspect of the present invention.
Figures 7A, 7B, 7C, 7D, 7E:
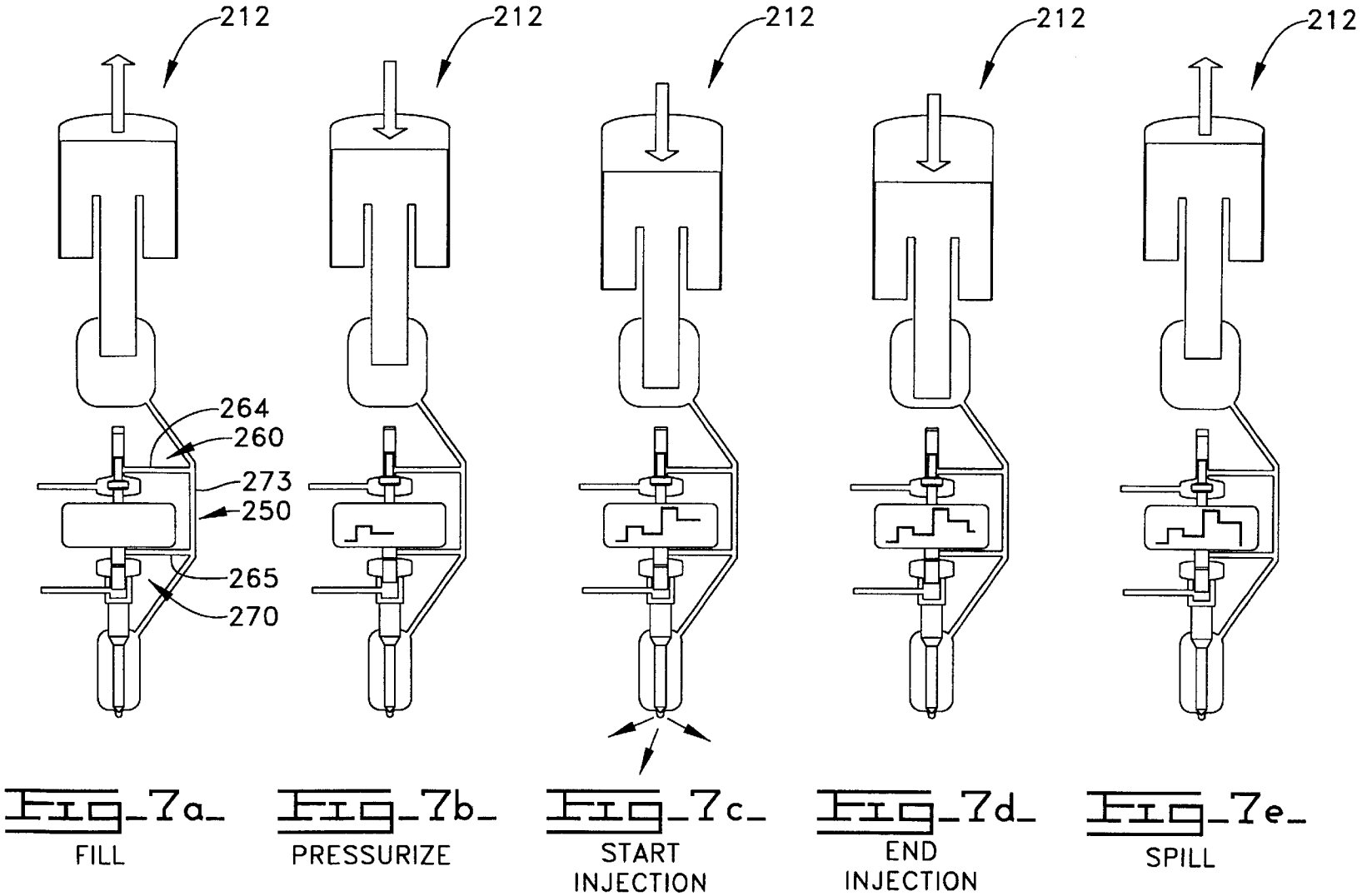
FIGS. 7A–E show a series of diagrammatic illustrations for a single injection cycle for a fuel injector according to still another aspect of the present invention.

Thus, in the preferred heavy fuel oil injection system embodiment illustrated in FIGS. 1–4, pressurization is controlled by opening and closing an actuation spill passage, and the opening and closing of the nozzle outlet is controlled by the application of high or low actuation fluid pressure to the closing hydraulic surface of the needle valve member. In one alternative embodiment, which would likely not be well suited to the use of heavy fuel oil, the opening and closing of the nozzle outlet could be controlled by the application of high or low pressure fuel to the closing hydraulic surface of the needle valve member. Referring briefly to FIG. 6A, such an embodiment would connect a pressure communication passage 165 to the nozzle fuel supply passage 173 rather than connecting the pressure communication passage to the actuation fluid flow passages as in the embodiment shown and described in FIGS. 1–4. Referring now briefly to FIG. 7A, still another embodiment of the present invention could control pressurization by closing or opening a fuel spill passage, and the direct control needle valve could control opening and closing of the nozzle outlet by the application of high or low pressure fuel to the closing hydraulic surface of the needle valve member. Thus, in this alternative embodiment, a spill passage 264 and a pressure communication passage 265 would be fluidly connected to the nozzle supply passage 273, which carries high pressure fuel to the nozzle.

INDUSTRIAL APPLICABILITY

Figures 5A, 5B, 5C, 5D, 5E:
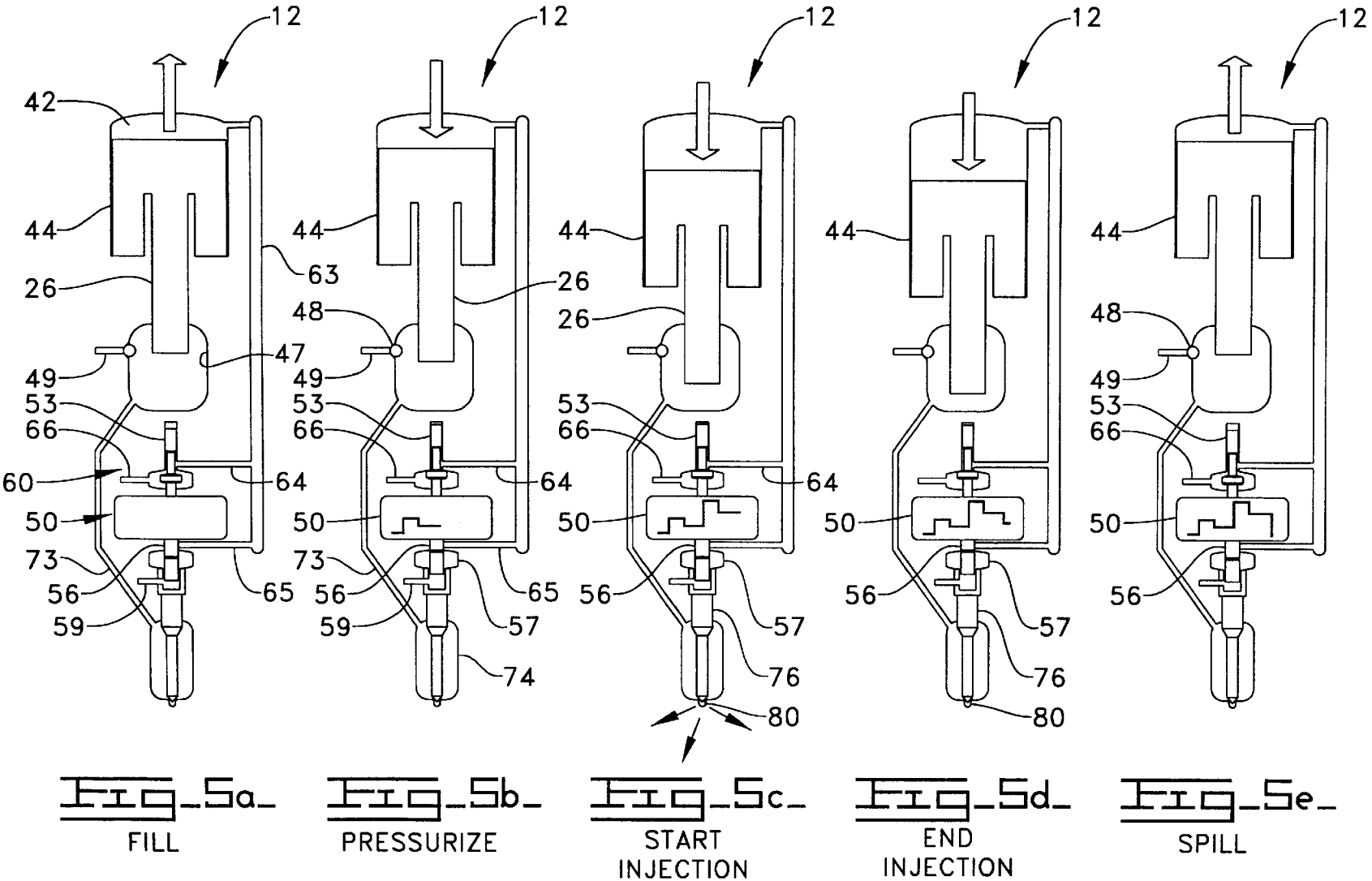
FIGS. 5A–E are a series of diagrammatic illustrations showing various events within the fuel injector during a single injection cycle.

Referring now to FIGS. 1–4, and in addition to FIGS. 5A–E, the operation of fuel injection system 10 for a single fuel injector 12 is illustrated for one injection cycle. Between injection events, mechanical unit pump 13 is drawing fresh lubricating oil into its pumping chamber 33 from actuation fluid reservoir 20. Also between injection events, the various components within fuel injector 12 are resetting themselves for a subsequent injection event as illustrated in FIG. 5A. In particular, pumping element 26 is retracting under the action of return spring 44 to displace actuation fluid from cavity 42, through actuation fluid passage 63 and eventually out of drain 43 past an open spill valve 60. At the same time, low pressure fuel is drawn into fuel pressurization chamber 47 through fuel inlet 49, past check valve 48. Needle valve member 76 remains in its downward closed position under the action of its biasing spring 77.

Each injection cycle begins as cam 16 causes pump plunger 32 to displace actuation fluid from mechanical unit pump 13 toward fuel injector 12 through supply line 14. The pressurization portion (FIG. 5B) of the injection cycle begins by applying a relatively low current to solenoid 50 to move spill valve member 53 to its upward closed position. When this occurs, actuation fluid within injector 12 is relatively trapped and pressure begins to build rapidly. This high pressure begins to act upon pumping element 26, and it starts moving downward for its pumping stroke. When this occurs, check valve 48 closes and fuel within fuel pressurization chamber 47, nozzle supply passage 73 and nozzle chamber 74 rises rapidly to injection pressure levels. However, needle valve member 76 remains in its downward closed position because the high actuation pressure is being communicated to the closing hydraulic surface 78 of needle piston 79 since needle control valve member 56 has only been moved to a middle position at which needle control seat remains open. After spill valve member 53 has been moved upward to its closed position, the solenoid current can be dropped to an even lower hold level which is sufficient to hold spill valve 60 in its closed position.

Each injection event is initialized by applying a relatively high current to solenoid 50 as shown in FIG. 5C. When this occurs, needle control valve member 56 is further lifted to its upward on or closed position to relieve the high pressure acting on closing hydraulic surface 78 of needle valve member 76. Because fuel pressure at this time is likely to be well above valve opening pressure, needle valve member 76 moves to its upward open position and the spray of fuel commences out of nozzle outlet 80. Shortly after solenoid 50 is raised to this higher current level, the current may be lowered to a high hold level which is sufficient to hold both needle control valve member 56 and spill valve member 53 in their upward closed positions. Thus, solenoid 50 is preferably a three position solenoid with different positions that are controlled and engineered by choosing current levels and appropriate spring strengths for weak biasing spring 54 and strong biasing spring 55.

Each injection event is ended (FIG. 5D) by dropping the solenoid current to its low hold position which maintains spill valve member 53 in its upward closed position, but allows needle control valve member 56 to move to its middle open position to communicate high pressure actuation fluid on to the closing hydraulic surface 78 of needle valve member 76. This application of high pressure fluid to the top of needle valve member 76 causes it to abruptly move downward to its closed position even though fuel pressure remains relatively high. After the nozzle outlet 80 has closed, the solenoid current level is completely de-energized (FIG. 5E), which allows spill valve member 53 to move to its downward open position to relieve actuation fluid pressure to drain 43. This in turn causes pumping element 26 to cease its downward pumping stroke under the action of its return spring 44 and begin retracting upward for a subsequent injection event. Those skilled in the art will appreciate that by appropriately sizing various hydraulic surfaces, the shape of cam 16 and the current levels applied to solenoid 50, various injection rate shapes could be produced by injector 12. These include, but are not necessarily limited to, the possibility of split injections, ramp, ramp-square, square, and boot shaped injection profiles.

Referring now to FIGS. 6A–6E, a second embodiment of the present invention includes a fuel injector 112 that utilizes high pressure fuel in the operation of its direct control needle valve 170, as opposed to the use of high pressure actuation fluid as in the previous embodiment. Nevertheless, injector 112 performs substantially identical to that of the earlier embodiment. In particular, during the fill phase illustrated in FIG. 6A, the pumping element is undergoing its upward pumping stroke, and the used actuation fluid in the actuation fluid cavity is displaced through actuation fluid passage 163 past spill valve 160 toward the drain. At the same time, fresh low pressure fuel is drawn into the fuel pressurization chamber from the fuel inlet. During the pressurization phase as illustrated in FIG. 6B, the pumping element is undergoing its downward pumping stroke since the spill valve member 160 has closed due to the application of a relatively low current to solenoid 150. Because the solenoid current is low, the direct control needle valve 170 remains open such that the high pressure in the fuel is communicated to the closing hydraulic surface of the needle valve member. At the start of injection as illustrated in FIG. 6C, the solenoid current is raised to a higher level which causes the direct control needle valve 170 to close to relieve the fuel pressure on the top of the needle valve member. This allows it to lift to its upward open position to commence the injection of fuel. Like the earlier embodiment, each injection event is ended by lowering the solenoid current level to reopen the direct control needle valve. This causes high pressure fuel to act on the closing hydraulic surface of the needle valve to again close it and end the injection event. Shortly after the nozzle outlet is closed, the solenoid current level is dropped to zero to allow residual pressure to spill as shown in FIG. 6E by reopening spill valve 160.

Referring now to FIGS. 7A–7E, the operation of a third embodiment of a fuel injector 212 is illustrated. In this embodiment, pressurization and direct needle control are maintained through the flow control of fuel only, and the actuation fluid is used only to move the pumping element. Nevertheless, this fuel injector operates substantially identical to the two previous embodiments. In particular, during the fill phase as shown in FIG. 7A, the solenoid 250 is de-energized, spill valve 260 is open and the direct control needle valve 270 is opened. During the pressurization phase, as shown in FIG. 7B, a low current is applied to solenoid 250 to close spill valve 260. This allows fuel pressure to rise, but the needle valve member will remain closed since the high pressure fuel is acting both on the opening and closing hydraulic surfaces of the needle valve member. FIG. 7C shows the start of injection which is accomplished by sending a higher current level to solenoid 250 to close the direct control needle valve 270 and relieve the high fuel pressure acting on the closing hydraulic surface of the needle valve member. This allows the needle valve member to lift to its open position and commence the spray of fuel out of the nozzle outlet. The fuel injection event is ended by lowering the current level to the solenoid to reopen the direct control needle valve and reapply high pressure fuel to the closing hydraulic surface of the needle valve member. This causes the needle valve member to move to its downward closed position and end the injection event. Shortly after the nozzle outlet is closed, the solenoid may be completely de-energized to reopen the spill valve and relieve any remaining pressure in the fuel injector 212.

The present invention includes several features that render it attractive over previous systems. Among these are the ability of the first embodiment to inject heavy fuel oil, or residual fuel. Since the valving and the electronics are isolated from the fluid that is being injected, the injector should have high tolerance for low grade fuels. In addition, use of relatively simple mechanical unit pumps provides a moderate pressure working fluid for powering an amplifier piston in the individual injectors. The same working fluid is used in the valve circuits, eliminating the problems associated with high pressure fuel lines, intersecting holes and plugs. This fluid can be distillate diesel fuel, engine oil or some other suitable type of fluid in a separate circuit. Finally, the injector utilizes a single solenoid/multi-current system for actuating the spill valve, or pressure control valve, and the direct control needle valve. These control and plumbing strategies allow for improved structural capability and low cost. The present invention can rely upon relatively simple mechanical unit pumps that provide a moderate pressure working fluid to the individual injectors and eliminate the expense and reliability problems of high pressure fuel lines and their associated connections. In addition, the single two wire solenoid and armature that actuate the spill valve and direct control needle valve have the ability to control timing, delivery, and some rate shaping including the ability to provide for multiple injections per cycle. The second and third embodiments retain most of the advantageous features of the preferred embodiment, but they might not be suitable for use with low grade fuels and may sacrifice some of the advantages in the injector hydraulic circuitry.

The above description is intended for illustrative purposes only and is not intended to limit the scope of the present invention in any way. Various modifications could be made to the disclosed embodiments without otherwise departing from the intended spirit and scope of the invention, which is defined in terms of the claims set forth below.

We claim:

1. A fuel injection system comprising:

a plurality of mechanical unit pumps, each having a pump outlet;

a pressure-intensifying hydraulically-actuated electronically-controlled fuel injector for each of said plurality of mechanical unit pumps, and each of said fuel injectors having a direct control needle valve and an injector body defining an actuation fluid inlet, a fuel inlet, an actuation fluid cavity and a fuel pressurization chamber, and including a movable pumping element with a large hydraulic surface exposed to fluid pressure in said actuation fluid cavity and a small hydraulic surface exposed to fluid pressure in said fuel pressurization chamber; and an actuation fluid supply line for each of said plurality of mechanical unit pumps, and each said supply line fluidly connecting one said pump outlet to one said actuation fluid inlet.

2. The fuel injection system of claim 1 wherein said injector body includes a spill passage and each said fuel injector includes an electronically controlled spill valve movable between a spill position in which said spill passage is open and a pressurization position in which said spill passage is closed.

3. The fuel injection system of claim 2 wherein one end of said spill passage is fluidly connected to said actuation fluid cavity.

4. The fuel injection system of claim 2 wherein one end of said spill passage is fluidly connected to said fuel pressurization chamber.

5. The fuel injection system of claim 1 wherein said direct control needle valve includes a needle valve member with a closing hydraulic surface exposed to fluid pressure in a needle control chamber defined by said injector body, and a needle control valve attached to said injector body and moveable between an on position in which said needle control chamber is open to a low pressure passage, and an off position in which said needle control chamber is open to a pressure communication passage.

6. The fuel injection system of claim 5 wherein one end of said pressure communication passage is fluidly connected to said actuation fluid cavity.

7. The fuel injection system of claim 5 wherein one end of said pressure communication passage is fluidly connected to said fuel pressurization chamber.

8. The fuel injection system of claim 1 wherein each said fuel injector includes a spill valve and a single electrical actuator attached to said injector body and operably coupled to said spill valve and said direct control needle valve.

9. The fuel injection system of claim 1 wherein said fuel inlet is fluidly connected to a source of heavy fuel oil; and said actuation fluid cavity contains a hydraulic fluid that is different from said heavy fuel oil.

10. A fuel injection system comprising:

a plurality of mechanical unit pumps, each having a pump outlet;

a pressure-intensifying hydraulically-actuated electronically-controlled fuel injector for each of said plurality of mechanical unit pumps, and each of said fuel injectors having a direct control needle valve, a spill valve and an injector body defining an actuation fluid inlet, a fuel inlet, an actuation fluid cavity and a fuel pressurization chamber, and including a movable pumping element with a large hydraulic surface exposed to fluid pressure in said actuation fluid cavity and a small hydraulic surface exposed to fluid pressure in said fuel pressurization chamber, and further including a single electrical actuator attached to said injector body and operably coupled to said spill valve and said direct control needle valve; and an actuation fluid supply line for each of said plurality of mechanical unit pumps, and each said supply line fluidly connecting one said pump outlet to one said actuation fluid inlet.

11. The fuel injection system of claim 10 wherein said injector body includes a spill passage and said spill valve is movable between a spill position in which said spill passage is open and a pressurization position in which said spill passage is closed.

12. The fuel injection system of claim 11 wherein said direct control needle valve includes a needle valve member with a closing hydraulic surface exposed to fluid pressure in a needle control chamber defined by said injector body, and a needle control valve attached to said injector body and moveable between an on position in which said needle control chamber is open to a low pressure passage, and an off position in which said needle control chamber is open to a pressure communication passage.

13. The fuel injection system of claim 12 wherein one end of said spill passage is fluidly connected to one of said actuation fluid cavity and said fuel pressurization chamber.

14. The fuel injection system of claim 13 wherein one end of said pressure communication passage is fluidly connected to one of said actuation fluid cavity and said fuel pressurization chamber.

15. The fuel injection system of claim 14 wherein said fuel inlet is fluidly connected to a source of heavy fuel oil; and said actuation fluid cavity contains a hydraulic fluid that is different from said heavy fuel oil.

16. A heavy fuel injection system comprising:

a plurality of mechanical unit pumps, each having a pump outlet;

a pressure-intensifying hydraulically-actuated electronically-controlled fuel injector for each of said plurality of mechanical unit pumps, and each of said fuel injectors having a direct control needle valve, a spill valve and an injector body defining an actuation fluid inlet, a fuel inlet, an actuation fluid cavity and a fuel pressurization chamber, and including a movable pumping element with a large hydraulic surface exposed to fluid pressure in said actuation fluid cavity and a small hydraulic surface exposed to fluid pressure in said fuel pressurization chamber;

an actuation fluid supply line for each of said plurality of mechanical unit pumps, and each said supply line fluidly connecting one said pump outlet to one said actuation fluid inlet;

said fuel inlet being fluidly connected to a source of heavy fuel oil; and said actuation fluid cavity containing a hydraulic fluid that is different from said heavy fuel oil.

17. The heavy fuel injection system of claim 16 wherein each said fuel injector includes a single electrical actuator attached to said injector body and operably coupled to said spill valve and said direct control needle valve.

18. The heavy fuel injection system of claim 17 wherein said injector body includes a spill passage and said spill valve is movable between a spill position in which said spill passage is open and a pressurization position in which said spill passage is closed.

19. The heavy fuel injection system of claim 18 wherein said direct control needle valve includes a needle valve member with a closing hydraulic surface exposed to fluid pressure in a needle control chamber defined by said injector body, and a needle control valve attached to said injector body and moveable between an on position in which said needle control chamber is open to a low pressure passage, and an off position in which said needle control chamber is open to a pressure communication passage.

20. The heavy fuel injection system of claim 19 wherein one end of said spill passage is fluidly connected to said actuation fluid cavity; and one end of said pressure communication passage is fluidly connected to said actuation fluid cavity.

* * * * *